United States Patent [19]

Wakabayashi

[11] Patent Number: 4,577,785

[45] Date of Patent: Mar. 25, 1986

[54] HINGED ROTARY NOZZLE

[75] Inventor: Senzo Wakabayashi, Tokyo, Japan

[73] Assignees: Nippon Kokan Kabushiki Kaisha, Tokyo; Nippon Rotary Nozzle Co., Ltd., Kawasaki; Kokan Kikai Kogyo Kabushiki Kaisha; Tokyo Yogyo Kabushiki Kaisha, both of Tokyo, all of Japan

[21] Appl. No.: 667,758

[22] Filed: Nov. 2, 1984

Related U.S. Application Data

[63] Continuation-in-part of Ser. No. 138,845, Apr. 10, 1980, abandoned.

[30] Foreign Application Priority Data

Apr. 13, 1979 [JP] Japan ..... 54-44266

[51] Int. Cl.[4] ..... B22D 41/08

[52] U.S. Cl. ..... 222/598; 222/512; 222/548

[58] Field of Search ..... 222/598, 600, 512, 548, 222/555, 590, 591, 516, 517, 556; 164/337, 437

[56] References Cited

U.S. PATENT DOCUMENTS

| | | | |
|---|---|---|---|
| 3,511,471 | 5/1970 | Rossi | 222/598 |
| 3,760,992 | 9/1973 | Bieri | 222/598 |
| 3,760,993 | 9/1973 | Meier | 222/600 |
| 3,764,047 | 10/1973 | Inoue et al. | 222/598 |
| 3,786,969 | 1/1974 | Kelly | 222/600 |
| 3,850,351 | 11/1974 | Yoshihara | 222/598 |
| 4,314,659 | 2/1982 | Shapland | 222/590 |

FOREIGN PATENT DOCUMENTS

| | | | |
|---|---|---|---|
| 0111570 | 9/1981 | Japan | 222/598 |
| 0111571 | 9/1981 | Japan | 222/598 |
| 0103956 | 6/1983 | Japan | 164/337 |
| 0374454 | 2/1964 | Switzerland . | |
| 1449334 | 9/1976 | United Kingdom . | |
| 2052703 | 1/1981 | United Kingdom | 222/598 |

*Primary Examiner*—Joseph J. Rolla
*Assistant Examiner*—Louise S. Heim
*Attorney, Agent, or Firm*—Fleit, Jacobson, Cohn & Price

[57] ABSTRACT

A rotary nozzle engageable with the pouring nozzle of a ladle that contains molten metal for transporting or pouring purposes, or in the flow passage of a converter so as to allow the outflow of molten metal. The rotary nozzle includes a fixed plate brick, a fixed plate supporting frame, a rotor mounted on the outer periphery of the supporting frame by way of a bearing, and a sliding plate supporting frame holding a sliding plate brick secured to the rotor by means of a hinge so that it can be hingedly opened and closed. Hooks and spring means are carried by the sliding plate supporting frame to thereby prevent lowering of the sliding plate brick and to securely fasten the sliding plate supporting frame to the rotor. Cooperating lugs are carried by a door frame and by the sliding plate supporting frame and hydraulic jacks serve to draw the lugs together to maintain the door frame and the sliding plate supporting frame together when the hooks are released.

3 Claims, 4 Drawing Figures

HINGED ROTARY NOZZLE

CROSS-REFERENCE TO RELATED APPLICATION

This application is a continuation in part of applicant's copending application Ser. No. 138,845, abandoned, filed April 10, 1980, for Hinged Rotary Nozzle.

BACKGROUND OF THE INVENTION

1. Field of the Invention

The present invention relates to a new and novel hinged or door-type rotary nozzle adapted to be attached to the bottom pouring nozzle of a ladle which contains molten metal, or to a converter for transporting or pouring purposes to permit the outflow of the molten metal. More particularly, the invention relates to a hinged or door-type rotary nozzle of the type in which a rotor is mounted for rotation on the outer periphery of a fixed plate supporting frame through a bearing, and in which a sliding plate supporting frame is secured to the rotor by means of a hinge such that the sliding plate supporting frame may be opened and closed like a hinged door, as occasion demands, to thereby eliminate any preliminary setting for changing and maintenance of the bricks, and to make the changing and maintenance easier, and in which a plurality of spring cases each housing a spring for pressing a sliding plate brick against a fixed plate brick are provided therein, either with spring guide means or with stopper means to thereby prevent the leakage of molten metal.

2. Description of the Related Art

It is well known in the art that a rotary nozzle can be attached to the pouring nozzle of a ladle that contains molten metal for transporting and pouring purposes, or attached to the pouring hole of a converter to permit the pouring operation to be conducted more safely and accurately. Known rotary nozzles have been increasingly used along with the recent remarkable technical progress in such areas as the development of large sized ladles, continuous casting, etc. However, although many substantial advantages of the use of known rotary nozzles have been recognized, the actual circumstances have been such that the installation of a rotary nozzle on a ladle, a converter, or the like, requires that the rotary nozzle be preliminarily set at one location, transported to the location of a ladle, and then changed for the old one, which in turn will be transported to a location where the removed rotary nozzle is set again. As a result, it has been the practice to carry out the brick changing and so on in the course of the preliminary setting, and thus it has been impossible to minutely inspect, for example, the extent of wear of the bricks without disassembling the nozzle. Moreover, such preliminary setting requires a good deal of space and the changing operation requires not only extensive equipment, but also much time, including the setting time, thus producing a detrimental effect on costs.

The door-type rotary nozzle, which has enabled the rotary part inclusive of the sliding plate brick to be opened and closed through attachment by a hinge, has come into widespread use because of a number of advantages proper thereto such that the sliding surface can be exposed for inspection by the naked eye of the state of the plate surface of the stationary bottom plate brick or the sliding plate brick once the valve is opened, and that there is no need to have spare sets in store when the brick is exchanged or repaired, thus facilitating the exchange operation.

Further, known rotary nozzles include springs for pressing a sliding plate brick against a fixed plate brick, and because the springs are each mounted between the bottom plate of a spring case attached to the ladle base plate, or the like, to depend therefrom, and the lower surface of the sliding plate supporting frame, if, due to sliding movement and other causes during the pouring operation, molten metal penetrates from the bore edge portions, a phenomenon which is usually called "metal penetration" occurs around the nozzle bores of the fixed plate brick and the sliding plate brick, and in extreme cases the plate bricks will be borne by the penetrated metal. Simultaneously, due to the fact that the resiliency of the springs provided to press the fixed and sliding plates bricks closely against each other acts until the lower limit of their resiliency or the bottom dead center is reached, a gap will be produced between the bricks with resulting leakage of the molten metal through the gap.

SUMMARY OF THE INVENTION

This invention relates to a door-type rotary nozzle and more particularly to a door-type rotary nozzle mounted to the bottom discharge opening of the molten metal container such as a ladle or tundish for controlling the amount of molten metal discharged through said discharge opening through adjustment of the opening degree thereof.

The present invention has been made with a view to overcoming the foregoing deficiencies of the prior art rotary nozzles and provides a rotor having a rotor gear on the outer periphery thereof and that is disposed on the outer periphery of a fixed plate supporting frame so that the rotor and a sliding plate supporting frame can be opened and closed by means of a hinge without disengaging a drive gear from the rotor gear.

In the door-type rotary nozzle, a door frame including a sliding plate brick is pivotably mounted by a hinge to a stationary frame which is secured, either directly or through the medium of a mounting member, to the bottom molten metal discharge opening of a ladle or a tundish (hereafter collectively referred to as a molten steel ladle). The opening degree of the nozzle is adjusted by transmitting rotary power from a driving source, such as a motor, through a speed reducing gear or a counter gear to the sliding plate brick arranged in the door frame, that is, by rotating the sliding plate brick.

Resilient means are provided within the door frame for pressing the sliding plate brick to the stationary bottom plate brick for preventing an accident, such as leakage of molten metal, due, for example, to the penetration of molten metal from the bore edge portion onto the sliding surfaces of the sliding and stationary plate bricks. The force of reaction of these resilient means is supported by the stationary frame through the door frame and the hinge. When the door frame is opened for repair or exchange of parts, as mentioned above, the force of these resilient means render it difficult to disengage dogs that lock the door frame closed. The resilient means must be forcibly compressed in advance from the bottom of the door frame, as by a jack, for disengaging the dogs. Moreover, when the door frame is opened about a hinge with the dogs disengaged, the sliding plate brick is released from the compressive forces exerted by these resilient means and is apt to be dislodged from within the door frame, with consequent danger. Hence, the resilient means must be retained or compressed by some or other means.

The present invention provides an improved door-type rotary nozzle in which retention and compression of the resilient means can be effected simultaneously. It is a principal object of the present invention to provide for safe, reliable, and simplified opening and closing operation of the door frame, and also to enable the opening and closing operation to be effected through the use of a jack, to the exclusion of complicated additional structure.

The door-type rotary nozzle of the present invention includes a stationary bottom plate brick having a nozzle bore in register with a molten metal discharge opening at the bottom of a molten metal container, such as a ladle or tundish A stationary frame is mounted to the bottom of the container for attaching the stationary bottom plate brick to a portion of the discharge opening. An annular door frame is displaceably mounted to the stationary frame, and hinge means are provided for pivotably connecting the door frame with the stationary frame. A sliding plate brick is provided and has a nozzle bore capable of communication with the nozzle bore of the stationary bottom plate brick when the sliding plate brick is in surface contact with the stationary bottom plate brick. An inner frame is supported within the door frame and is adapted for holding the sliding plate brick in surface contact with the stationary bottom plate brick when the door frame is closed, the inner frame being adapted to permit a molten metal discharging collector nozzle to be removably attached thereto within the annular inner periphery of the door frame so that the collector nozzle is in communication with the nozzle bore in the sliding plate brick.

A plurality of dogs are pivotably mounted to the outer periphery of the door frame for holding the door frame closed by engaging with the stationary frame. Resilient means are provided and are mounted between the door frame and the inner frame and are adapted for pressing the sliding plate brick toward the stationary plate brick, which is in surface contact therewith when the door frame is closed, and in such a manner that the resulting reaction force is supported by the stationary frame through the dogs engaged with the stationary frame. Lug pairs are securely mounted to the door frame and the inner frame within the annular inner periphery of the door frame in opposition to each other, and are subjected to an exterior force acting to compress the resilient means when the door frame is opened. A drive mechanism is provided and is adapted for driving the inner frame in rotation from the outside, thereby causing the sliding plate brick to rotate relative to the stationary plate brick while the door frame remains closed. When opening the door frame, the dogs must be released from the force of reaction of the resilient means supported by the stationary frame through the dogs. To this end, the lug pairs are clamped together by a jack means or the like, for forcibly compressing the resilient means. The jack means may remain in the clamping state for maintaining the integrity of the door and inner frames, thereby preventing separation thereof from each other.

According to one embodiment of the invention, a plurality of lug pairs are mounted symmetrically to one another and to the annular inner wall region of said door frame for facing the axis of rotation of the inner frame. According to another embodiment of the invention, the drive mechanism includes an externally threaded annular gear rotor rotatably supported at the outer periphery of the stationary frame, the dogs are engaged with the rotor and the dogs are adapted for being rotated integrally by the rotor together with the inner frame and the sliding plate brick.

BRIEF DESCRIPTION OF THE DRAWINGS

The objects, features and advantages of the invention will become more apparent from the following description taken in conjunction with the accompanying drawings, in which.

DESCRIPTION OF THE PREFERRED EMBODIMENT

Figure 1:
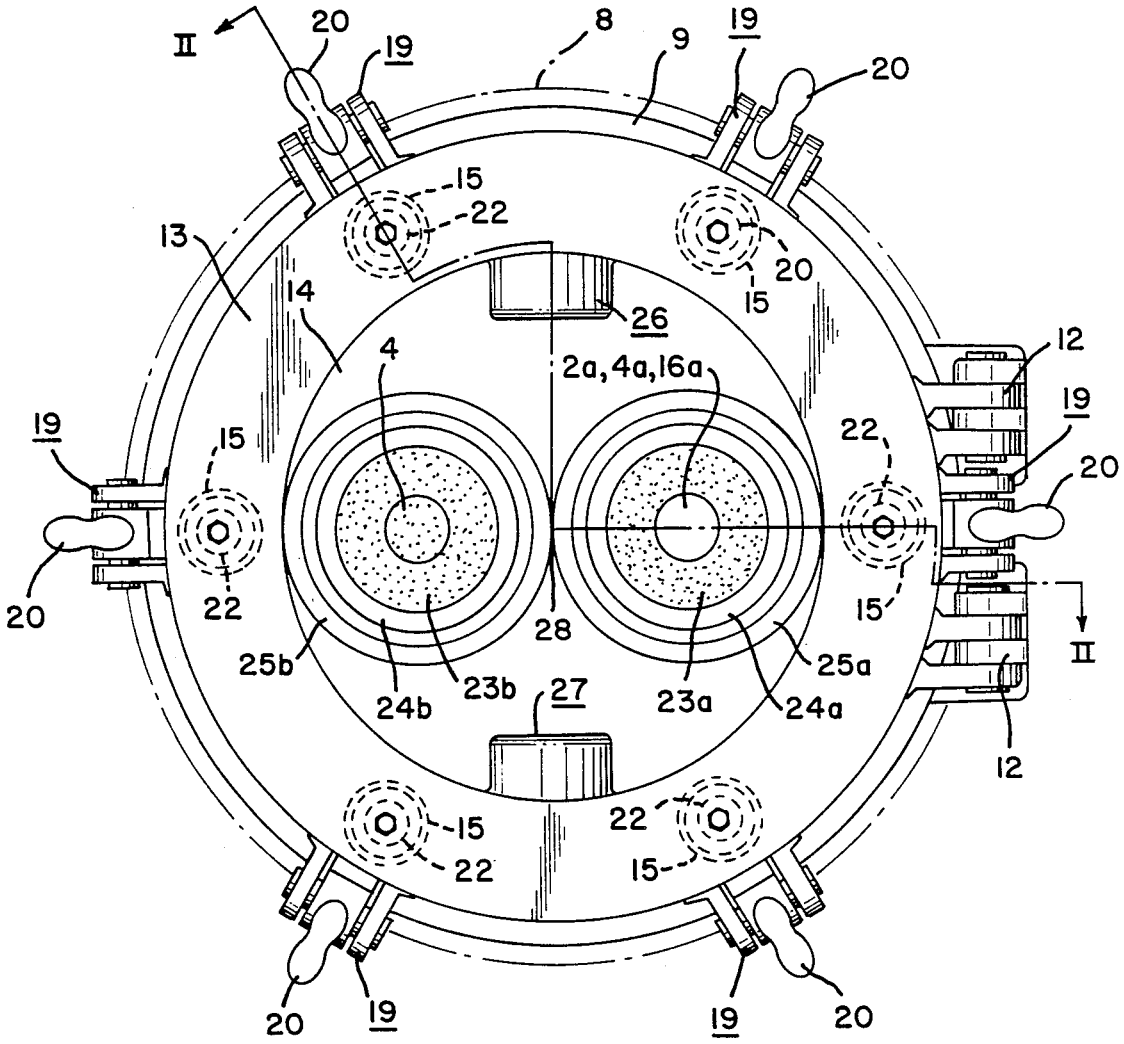
FIG. 1 is a bottom view showing a door type rotary nozzle in accordance with the present invention.

Referring to the drawings, there is shown a molten metal outlet at the bottom of a molten metal container 1, such as a ladle or a tundish, and the outlet includes an upper nozzle 2 in the form of a molded refractory material. The door-type rotary nozzle of the present invention is provided for controlling the opening and closing of the molten metal outlet to control the flow of the molten metal through the upper nozzle 2.

A base member 3 is provided for fixedly supporting the rotary nozzle of the present invention. On the base 3 is secured a stationary frame 5 adapted for holding a stationary bottom plate brick 4 in communication with the upper nozzle 2. The bottom plate brick 4 in the stationary frame 5 has a nozzle bore 4*a* in register with a nozzle opening 2*a* of the upper nozzle 2 when the two are in the assembled state, and the bottom plate brick is replaceably secured within the stationary frame 5 by suitable retaining means, 6 or by screws (not shown).

An externally threaded outer gear rotor 8 is provided on the outer periphery of the stationary frame 5 through the intermediary of a plurality of ball bearings 7, or the like, and is rotably driven by suitable driving means (not shown) which can include a drive gear coupled to a drive source such as a motor. An annular member 9 is connected with gear rotor 8 and has on its outer periphery a flange 10 for engagement by six dogs 19 at six peripheral positions around annular member 9, and has on its inner periphery projections 11 for direct transmission of rotary power to an inner frame 14 to be later described.

Figure 2:
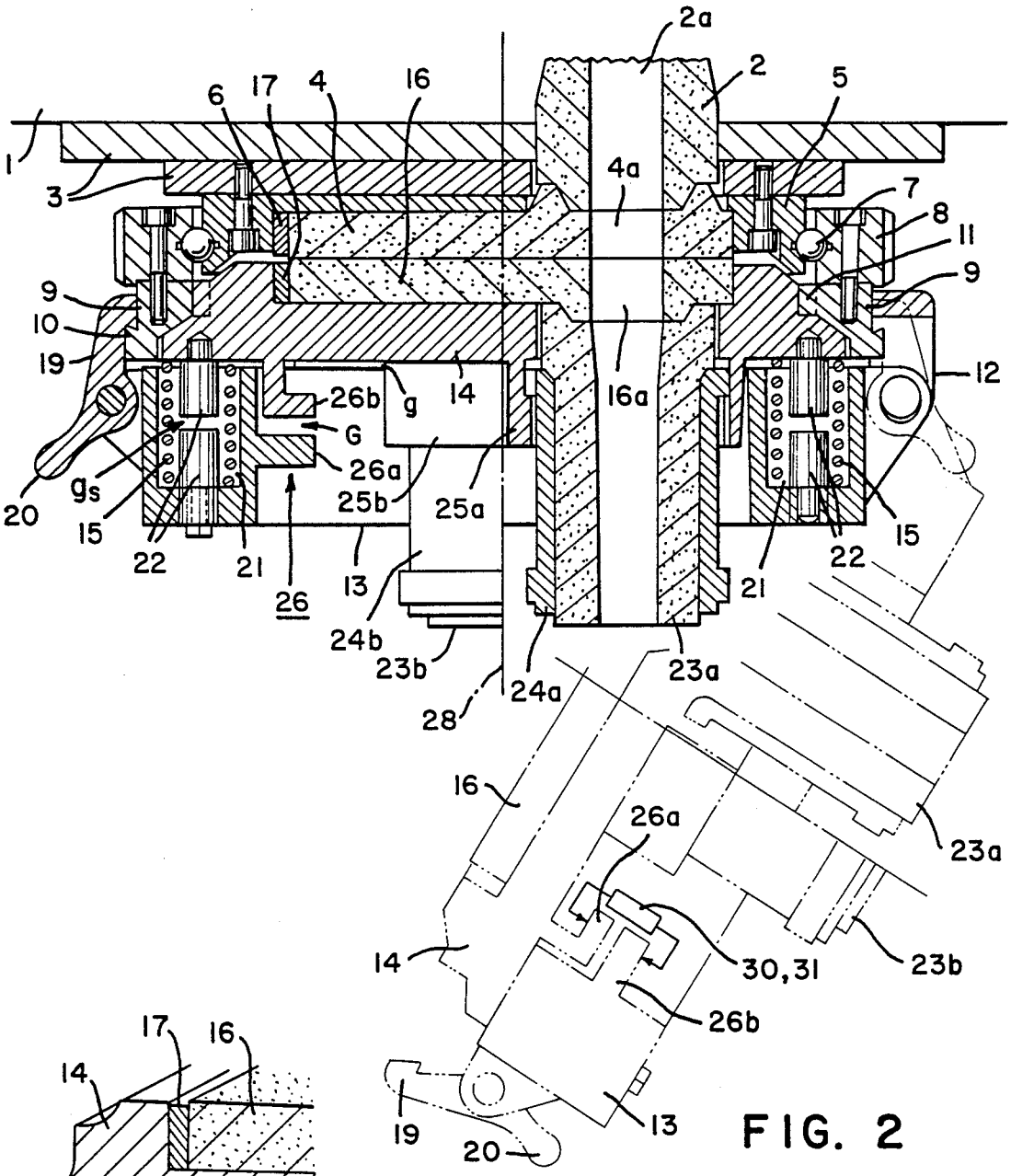
FIG. 2 is a longitudinal section taken along line II—II of FIG. 1 and looking in the direction of the arrow mark.
Figure 4:
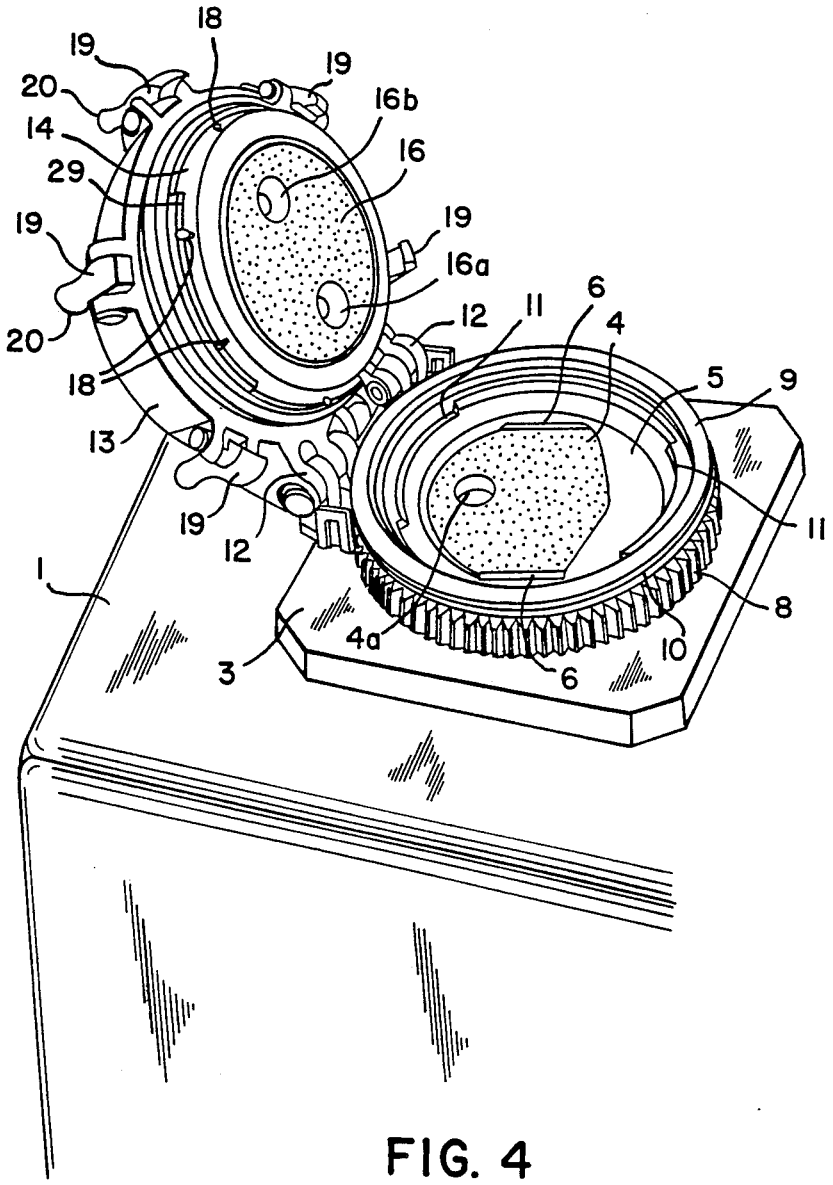
FIG. 4 is a perspective view showing the door-type rotary nozzle of the present invention with the molten metal container inverted and the door in the open position.

Hinge 12 is positioned on the periphery of the annular member 9 and carries an annular door frame 13 for opening or closing with respect to the annular member 9 of the stationary frame 5. The inner frame 14 is supported in the door frame 13 by resilient means, such as a plurality of springs 15. Reference numeral 16 designates a sliding plate brick replaceably carried in the inner frame 14 by suitable retaining means 17 or by screws 18 (see FIG. 4) and has two separate nozzle bores 16*a*, 16*b*, that can be brought into or out of communication with nozzle bore 4*a* of the stationary bottom plate brick 4 when the sliding plate brick 16 is in surface contact with the stationary bottom plate brick 4. The inner frame 14 operates in such a manner that when the door frame 13 is closed with respect to the annular member 9 of the stationary frame 5, the sliding plate brick 16 is brought into surface contact with the stationary bottom plate brick 4, the brick 16 being pressed by the spring force of the springs 15 against the stationary bottom plate brick 4 for providing a sufficient surface contact pressure to prevent metal penetration between the plate bricks. Dogs 19 provided at six places on the outer periphery of the door frame 13 support the force of reaction exerted by springs 15 and hold the door frame 13 in the closed condition. Dogs 19 are pivotably mounted to the door frame 13 and one of the ends thereof engage the flange 10 provided o the outer periphery of the annular member 9 of the stationary frame 5. A hand grip 20 is provided on the other end of each of dogs 19 for permitting engagment or disengagement of the dogs relative to flange 10. Springs 15 are each carried in an annular peripheral chamber 21 in the door frame 13 for resiliently acting between the door frame 13 and the inner frame 14. Springs 15 can be compression coil springs as shown, and guide-stopper members 22 are disposed in the inner zone of the springs as shown in FIG. 2 for guiding and preventing excessive deflection of springs 15.

In register with nozzle bores 16*a*, 16*b* in the sliding plate brick 16, two collector nozzles 23*a*, 23*b* are adapted to be attached at the side of the lower surface of the inner frame 14 in communication with nozzle bores 16*a*, 16*b*. In the drawings, 24*a*, 24*b* designate bayonet-type mounting cases adapted to receive and carry collector nozzles 23*a*, 23*b*, respectively, and reference numbers 25*a*, 25*b* designate bayonet-type holding sockets mounted in the inner frame 14.

Figure 3:
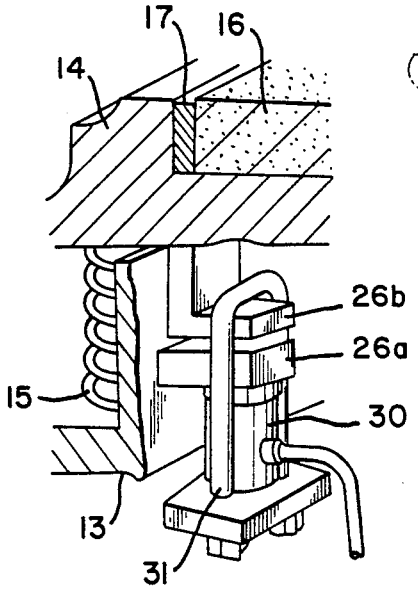
FIG. 3 is a perspective view showing essential parts in operation.

As shown clearly in FIG. 1, two pairs of lugs 26, 27 are provided at the inner annular periphery of the door frame 13 at symmetrical angular positions offset 90 degrees from the collector nozzles 23*a*, 23*b*. As shown in FIGS. 2 and 3 with respect to one such lug pair 26, each lug pair includes of a pair of lugs 26*a*, 26*b* superposed one above the other with a gap G therebetween. One lug 26*a* projects integrally from door frame 13 and the other lug 26*b* projects integrally from the inner frame 14. As shown in FIG. 2, the gap G is larger than the gap g between the upper surface of door frame 13 and the lower surface of inner frame 14, and also is larger than the gap between the stoppers 22. When the lugs are forced to draw near to each other against the force of springs 15, by the operation of a hydraulic jack 30 and a U-bolt base 31 as shown in FIG. 3 for compressing the springs 15, the door frame 13 approaches the annular member 9 of the stationary frame 5 so that the dogs 19 can be easily disengaged by hand. The other lug pair 27 is constructed similar to the lug pair 26 described above. Jack operation is effected a two positions symmetrical with respect to the center of rotation 28 for balanced compression of the peripherally distributed springs 15 while simultaneously the jack and the base ar operated for maintaining the compressed state so that the door frame 13 is not disengaged from the inner frame 14, even when the dogs 19 are disengaged and the door is opened by pivoting about hinge 12.

It should be noted that the inner frame 14 has a recess 29 matching with a projection 11 on the inner periphery of the annular member 9 when the door frame is closed. When the gear rotor 8 is rotated by a suitable driving gear, not shown, with the door frame 13 closed and the dogs 19 engaged, the force of rotation is transmitted from the annular member 9 to the inner frame 14 through projection 11 and recess 29. Thus the inner frame 14 and the sliding plate brick 16 are rotated relative to the stationary frame 5, and hence also relative to the stationary bottom plate brick 4, with door frame 13 being engaged by dogs 19, and without generating inner stress in the remaining portions, the extent of communication between the nozzle bores 4*a*, 16*a* depending upon their degree of registry, and being adjustable in this manner from fully closed to fully opened.

According to the door-type rotary nozzle of the present invention, lug pairs are provided on the inner periphery of the annular door frame 13 between the collector nozzles and are adapted to be drawn forcibly toward each other by a small sized jack for compressing the springs 15. In this manner, the door frame and the inner frame can be maintained under compression without providing cumbersome protruding parts around the rotating parts that may interfere with rotation thereof, thus greatly contributing to safety in the repair or replacement of bricks and to improved operating efficiency. Moreover, a larger force is not required in engaging or disengaging the dogs, the grip need not be of sturdy construction but a grip of reduced length is sufficient, thus dispensing with useless protruding portions.

In the foregoing embodiment, pressure is applied to the lug pair by hydraulic jack 30 and the U-bolt base 31. However, it should be noted that the hydraulic jack may be replaced by screw jack, if desired.

Although particular embodiments of the present invention have been illustrated and described, it will be apparent to those skilled in the art that various changes and modifications can be made without departing from the spirit of the present invention, and it is intended to encompass within the appended claims all such changes and modifications that are within the scope of the present invention.

I claim:

1. A door-type rotary nozzle for attachment to a bottom discharge opening of a molten metal container such as ladle or tundish, said nozzle comprising: a stationary bottom plate brick having a nozzle bore in register with said discharge opening; a stationary frame mounted to the bottom of said container for attaching said stationary bottom plate brick in surrounding relationship with said discharge opening; an annular door frame carried by said stationary frame; hinge means for pivotably connecting said door frame with said stationary frame; a sliding plate brick having a nozzle bore capable of communicating with said nozzle bore of said stationary bottom plate brick when the sliding plate brick is in surface contact with said stationary bottom plate brick; an inner frame supported within said door frame and adapted for holding said sliding plate brick in surface contact with said stationary bottom plate brick when said door frame is closed, said inner frame removably carrying a molten metal discharging collector nozzle to be removably attached thereto within an annular inner periphery of said door frame so that the collector nozzle is in communication with the nozzle bore in said sliding plate brick; a plurality of dogs pivotably mounted to the outer periphery of said door frame and holding the door frame closed by engaging with said stationary frame; compressible resilient means carried between said door frame and said inner frame and adapted for pressing said sliding plate brick toward said stationary plate brick which is in surface contact with said stationary bottom plate when said door frame is closed, so that the pressing is supported by said stationary frame when said dogs are kept engaged with said stationary frame; lug pairs securely mounted to said door frame and said inner frame within the annular inner periphery of said door frame and in opposition to each other; said lug pairs adapted to receive means for urging said lug pairs together to maintain said resilient means in compression when said door frame is opened; and drive means for driving said inner frame in rotation to thereby rotate said sliding plate brick relative to said stationary plate brick while said door frame remains closed.

2. A door-type rotary nozzle as recited in claim 1 wherein a plurality of said lug pairs are mounted symmetrically to one another on an annular inner wall region of said door frame and face to the center of rotation of said inner frame.

3. A door-type rotary nozzle as recited in claim 1 wherein said drive means includes an externally threaded annular gear rotor rotatably supported at the outer periphery of said stationary frame, and wherein said dogs are engaged with said rotor and said dogs and the door frame are adapted for being rotated integrally by said rotor together with said inner frame and said sliding plate brick.

* * * * *